US005321870A

United States Patent [19]

Wada et al.

[11] Patent Number: 5,321,870

[45] Date of Patent: Jun. 21, 1994

[54] TORSION BAR APPARATUS FOR SELF-CLOSING DOOR AND TORQUE ADJUSTING DEVICE THEREFOR

[75] Inventors: Hideatsu Wada; Kenichi Hiruma, both of Ohta, Japan

[73] Assignee: Sanyo Electric Co., Ltd., Osaka, Japan

[21] Appl. No.: 902,815

[22] Filed: Jun. 23, 1992

[30] Foreign Application Priority Data

Jul. 25, 1991 [JP] Japan ..... 3-186374

[51] Int. Cl.[5] ..... E05F 1/08

[52] U.S. Cl. ..... 16/300; 16/301; 16/308

[58] Field of Search ..... 16/300, 301, 308, 75

[56] References Cited

U.S. PATENT DOCUMENTS

| | | | |
|---|---|---|---|
| 18,164 | 9/1857 | Torrey et al. | 16/75 |
| 2,810,153 | 10/1957 | Semar | 16/308 |
| 2,869,959 | 1/1959 | Kesling | 16/308 |
| 3,109,194 | 11/1963 | Hay | 16/308 |
| 4,696,078 | 9/1987 | Stromquist . | |
| 4,905,347 | 3/1990 | Worth | 16/308 |

FOREIGN PATENT DOCUMENTS

| | | | |
|---|---|---|---|
| 3023950 | 1/1982 | Fed. Rep. of Germany | 16/308 |

*Primary Examiner*—Armine Cuda
*Attorney, Agent, or Firm*—Townsend & Banta

[57] ABSTRACT

A torsion bar apparatus for a self-closing door. The longitudinal dimension of the apparatus is reduced while the initial torque when the door is closed is maintained and the weight applied to the user during the door opening operation is reduced. One vertical side of a door is rotatably supported by a frame by means of hinges. One end of a first torsion bar is fixed to a frame, and a connecting member is fixed to the other end of the first torsion bar so as to be unable to rotate. In this state the first torsion bar is rotatably and vertically movably inserted into the door. One end of a second torsion bar is engaged with the connecting member so as to be unable to rotate and movable in the longitudinal direction and the second torsion bar is extended toward the one end of the first torsion bar and the other end of the second torsion bar is fixed to the door.

5 Claims, 15 Drawing Sheets

TORSION BAR APPARATUS FOR SELF-CLOSING DOOR AND TORQUE ADJUSTING DEVICE THEREFOR

BACKGROUND OF THE INVENTION

1. Field of the Invention

The present invention relates to a self-closing door apparatus and, more particularly, to a torsion bar apparatus used in a self-closing door apparatus for automatically closing a door by the self-aligning torque which is generated when a torsion bar is twisted, and a torque adjusting device for such a torsion bar apparatus.

This kind of self-closing door apparatus is conventionally adapted to a wide field of refrigerating machines and equipments such as refrigerators and showcases equipped with a freezer, and is very useful for preventing the cold air from leaking out of the door which is left open. As described in U.S. Pat. No. 4,696,078, the torque for closing a door is generated in most cases by the self-aligning torque of a twisted torsion bar (referred to as torque rod in the above-described U.S. Pat. specification).

According to the above-described U.S. Pat. specification, the upper end of a torsion bar (torque rod) is fixed to a door, and the hexagonal head portion at the lower end of the torsion bar (torsion rod) is engaged with a hexagonal opening of a worm wheel so as to be unable to rotate. When the upper portion of the torsion bar (torque rod) is rotated with the door opening operation, the torsion bar (torque rod) is twisted. The self-aligning torque generated by the twisted torsion bar urges the door to rotate in the direction in which the door is closed.

This structure, however, has the following defects. In this type of self-closing door apparatus, a certain initial torque is necessary in order to stably maintain the closed state of a door, but it is preferable for the user, who feels the weight of the door, that the torque during the opening operation is small. However, the self-aligning torque of the torsion bar increases in proportion to the angle of torsion of the torsion bar. If the gradient of the straight line indicating this proportional relationship is steep, a large force is required for opening the door, thereby deteriorating the operability.

The flexibility of a torsion bar is proportional to the length and inversely proportional to the sectional area thereof. Therefore, if two torsion bars are made of the same material and have the same sectional area, the one having a greater length has a gentler gradient in the straight line which indicates the proportional relationship between the self-aligning torque and the angle of torsion. However, if the length of the torsion bar is increased too much, the torsion bar comes into contact with the electric wiring and the like within the door and involves a fear of impairing the electric wiring.

In the torsion bar (torque rod) described in U.S. Pat. No. 4,696,078, the worm wheel is rotated by a worm so as to adjust the torsional torque of the torsion bar (torque rod), that is, to adjust the initial torque of the torque rod in the door-closed state. According to this structure, the user can freely adjust the torque of the torsion bar generated by the door closing operation. It is also possible to continuously adjust the degree of torsion of the torsion bar (torque rod).

In this structure, however, since the worm wheel is rotated by the worm in order to apply the initial torque to the torsion bar (torque rod), the torsion bar (torque rod) is not twisted by stages. It is therefore difficult to quantitatively detect the torque applied. Especially, in the case of adjusting the torque in the direction of reduction, since the point at which the initial torque is zero is not clear, the degree of torsion is sometimes inconveniently reduced to a point exceeding zero by not only restoring the twisted torsion bar (torque rod) to the original position but further twisting, thereby generating a torque for opening the door.

In addition, in the case of restoring the degree of torsion of the torsion bar (torque rod) to zero when the door is replaced, for example, in order to change the direction in which the door is opened, since the point at which the initial torque is zero is not clear, as described above, the hexagonal head portion of the torsion bar (torque rod) must sometimes be released from the worm wheel in the state in which the torsion bar is still twisted. In this case, when the engagement between the hexagonal head and the worm wheel is cancelled, the torsion bar (torque rod) rotates forcibly, thereby involving a risk of breaking parts or injuring the worker.

SUMMARY OF THE INVENTION

Accordingly, it is an object of the present invention to eliminate the above-described problems in the prior art and to provide a torsion bar apparatus for a self-closing door which is reduced in the total length and the weight applied to the user during the door opening operation while securing the initial torque for maintaining the door closed state.

It is another object of the present invention to provide a torque adjusting device for a torsion bar apparatus which is capable of quantitatively detecting the degree of torsion of the torsion bar apparatus and easily restoring the torsion bar to the state in which the initial torque is zero.

To achieve this aim, in one aspect of the present invention, there is provided a torsion bar apparatus for a self-closing door comprising: a first torsion bar with one end thereof fixed to a frame; a connecting member which is fixed to the other end of the first torsion bar so as to be unable to rotate and which is vertically movably and rotatably inserted into a door; and a second torsion bar one end of which is engaged with the connecting member so as to be unable to rotate and be movable in the longitudinal direction and which extends toward the one end of the first torsion bar until the other end thereof is fixed to the door.

In another aspect of the present invention, there is provided a torque adjusting device for a torsion bar apparatus for self-closing doors comprising: a rotating member which is rotatable so as to adjust the torque of the torsion bar, with which one end of the torsion bar is engaged so as to be unable to rotate, and which includes a holding portion and a gear portion for receiving the end portion of the torsion bar apparatus; and a stopper for selectively switching the directions in which the rotating member is rotatable with respect to the frame, the stopper including engaging portions which are pressed to removably engage the gear portion.

The above and other objects, features and advantages of the present invention will become clear from the following description of the preferred embodiments thereof, taken in conjunction with the accompanying drawings.

DESCRIPTION OF THE PREFERRED EMBODIMENTS

Figure 1:
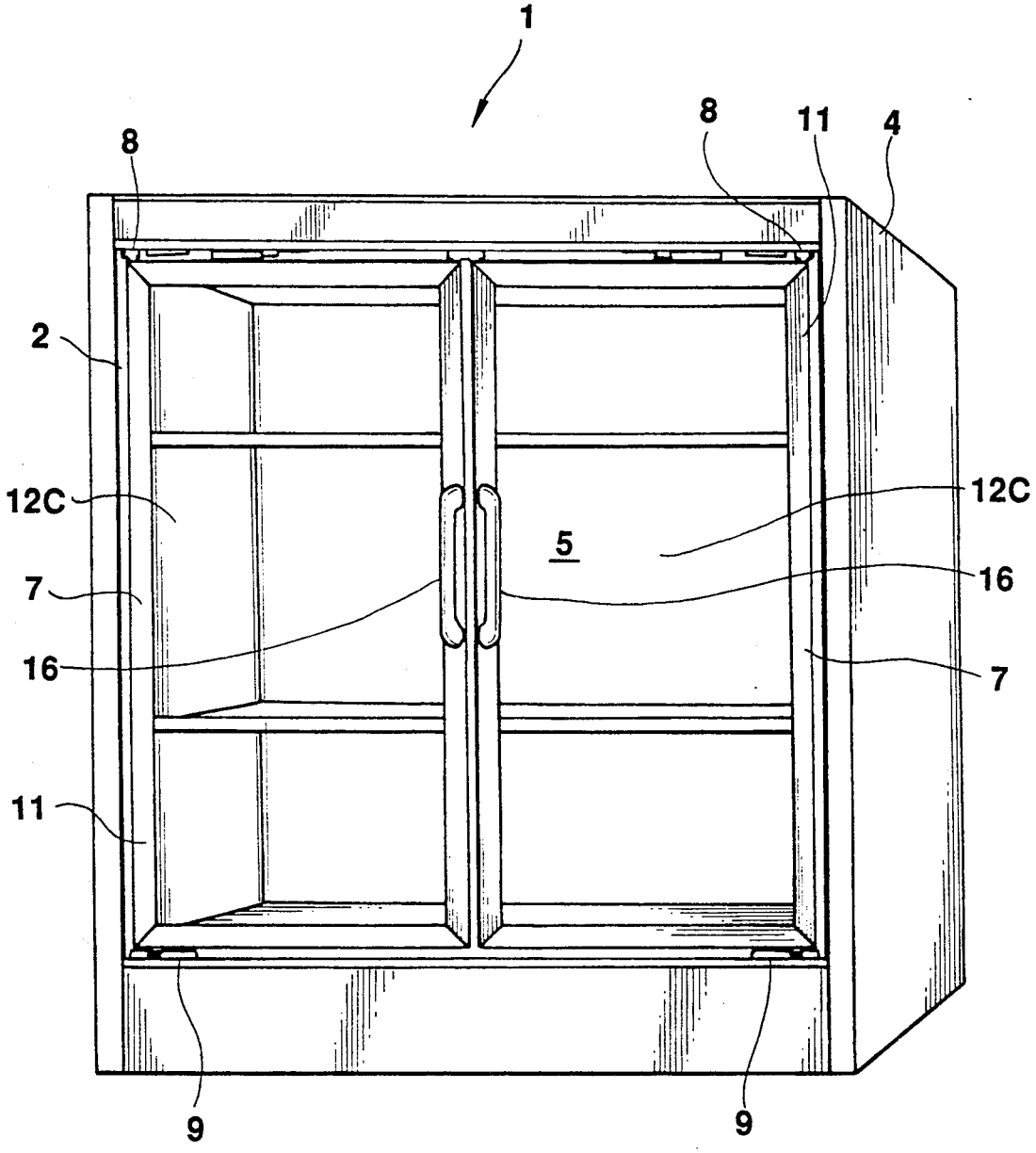
FIG. 1 is a perspective view of a refrigerator.

A torsion bar apparatus for a self-closing door according to the present invention comprises: a first torsion bar with one end thereof fixed to a frame; a connecting member which is fixed to the other end of the first torsion bar so as to be unable to rotate and which is vertically movably and rotatably inserted into a door; and a second torsion bar one end of which is engaged with the connecting member so as to be unable to rotate and be movable in the longitudinal direction and which extends toward the one end of the first torsion bar until the other end thereof is fixed to the door.

Therefore, when the door is opened, the end of the second torsion bar which is fixed to the door rotates around the end of the first torsion bar which is fixed to the frame, and the second torsion bar is twisted. The torsion is transmitted to the first torsion bar through the connecting member, thereby also twisting the first torsion bar. At this time, the rate of change of the self-closing torque which is applied to the entire part of the torsion bar apparatus to the rotation angle of the opening door is smaller than in the case in which only either the first torsion bar or the second torsion bar is provided. More specifically, the curve of the rate of change in the torsion bar apparatus of this embodiment is as gentle as the curve of the rate of change in the case in which either the first or the second torsion bar having about twice the length is provided. On the other hand, the entire length of the torsion bar apparatus of this embodiment is substantially the same as the length of either the first or the second torsion bar.

A torque adjusting device for the torsion bar apparatus for self-closing doors according to the present invention comprises: a rotating member which is rotatable so as to adjust the torque of the torsion bar, with which one end of the torsion bar is engaged so as to be unable to rotate, and which includes a holding portion and a gear portion for receiving the end portion of the torsion bar apparatus; and a stopper for selectively switching the directions in which the rotating member is rotatable with respect to the frame of the rotating member, the stopper including an engaging portion which is urged to removably engage the gear portion. In order to twist the torsion bar apparatus, the direction of rotation of the stopper is changed over to the direction which allows the rotating member to rotate in the direction of application of the torque for closing the door. In this case, the degree of torsion of the torsion bar, namely, the rotation angle of the rotating member is quantitatively detected by counting the clatter or the shock produced every time a tooth of the gear portion comes into contact with the engaging portion of the stopper. The rotating member is rotated by the self-aligning torque of the torsion bar apparatus and restored to the state in which the initial torque is zero simply by cancelling the engagement between the engaging portion of the stopper and the gear portion.

An embodiment of the present invention will be explained with reference to the accompanying drawings. In FIG. 1, the heat insulating box body 4 of a refrigerator 1 has an opening at the front portion and the portion defined by the inner wall of the heat insulating box body 4 constitutes a storeroom 5. Cold air is supplied from a freezer (not shown) into the storeroom 5 so as to keep the interior of the storeroom 5 at a low temperature. A self-closing door apparatus 2 is fundamentally composed of an aluminum frame 6 attached to the opening edge of the heat insulating box body 4, and two doors 7 of 1,400 mm long. One vertical side of each door 7 is rotatably supported by the frame 6.

Figure 2:
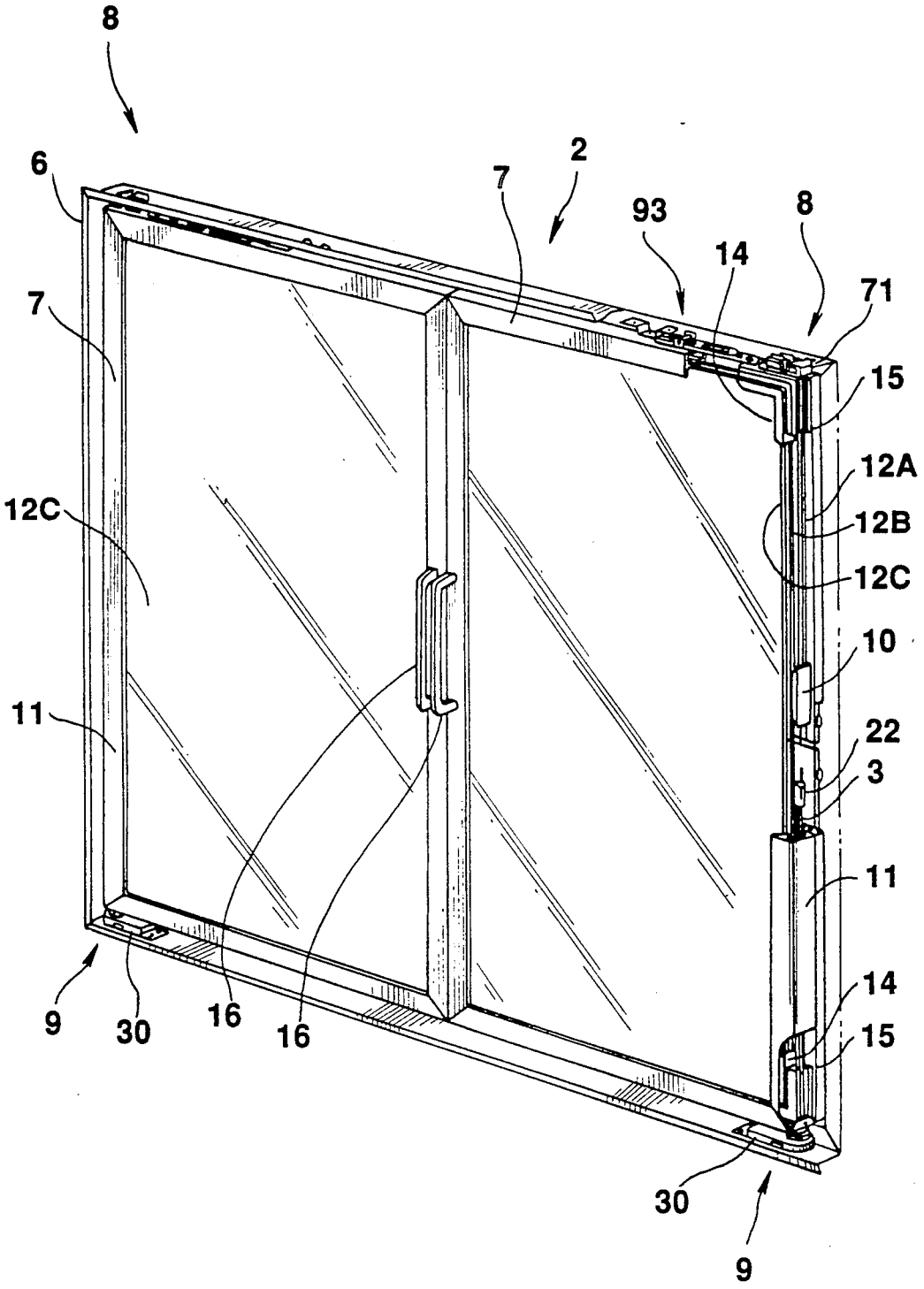
FIG. 2 is a partially cutaway view of a self-closing door apparatus.

In FIG. 2, the doors 7 are rotatably supported by upper hinge devices 8 and lower hinge devices 9 like what is called French doors. It is possible to change the direction in which the doors swing by changing the positions of the upper and the lower hinge devices 8, 9 on the frame 6 to the positions on the frame 6 which correspond to the upper and the lower ends of the other vertical sides of the doors 7, and turning the doors 7 upside down.

The door 7 is composed of an aluminum sash 11, an inner pane 12A, an intermediate pane 12B, an outer pane 12C, glass packings 14 made of a soft resin, L-shaped corner reinforcing fitting metals 15 each of which is produced by zinc die-cast and inserted into a corner of the door 7, and a handle 16. The door 7 is made vertically symmetric so as to allow vertical inversion. Lead wires are introduced from the upper hinge device 8 to a heater disposed within the door 7, as will be described later, and are connected within a cover 10 at the center of the sash 11, namely, 700 mm distant from the upper end of the door 7.

Figure 3:
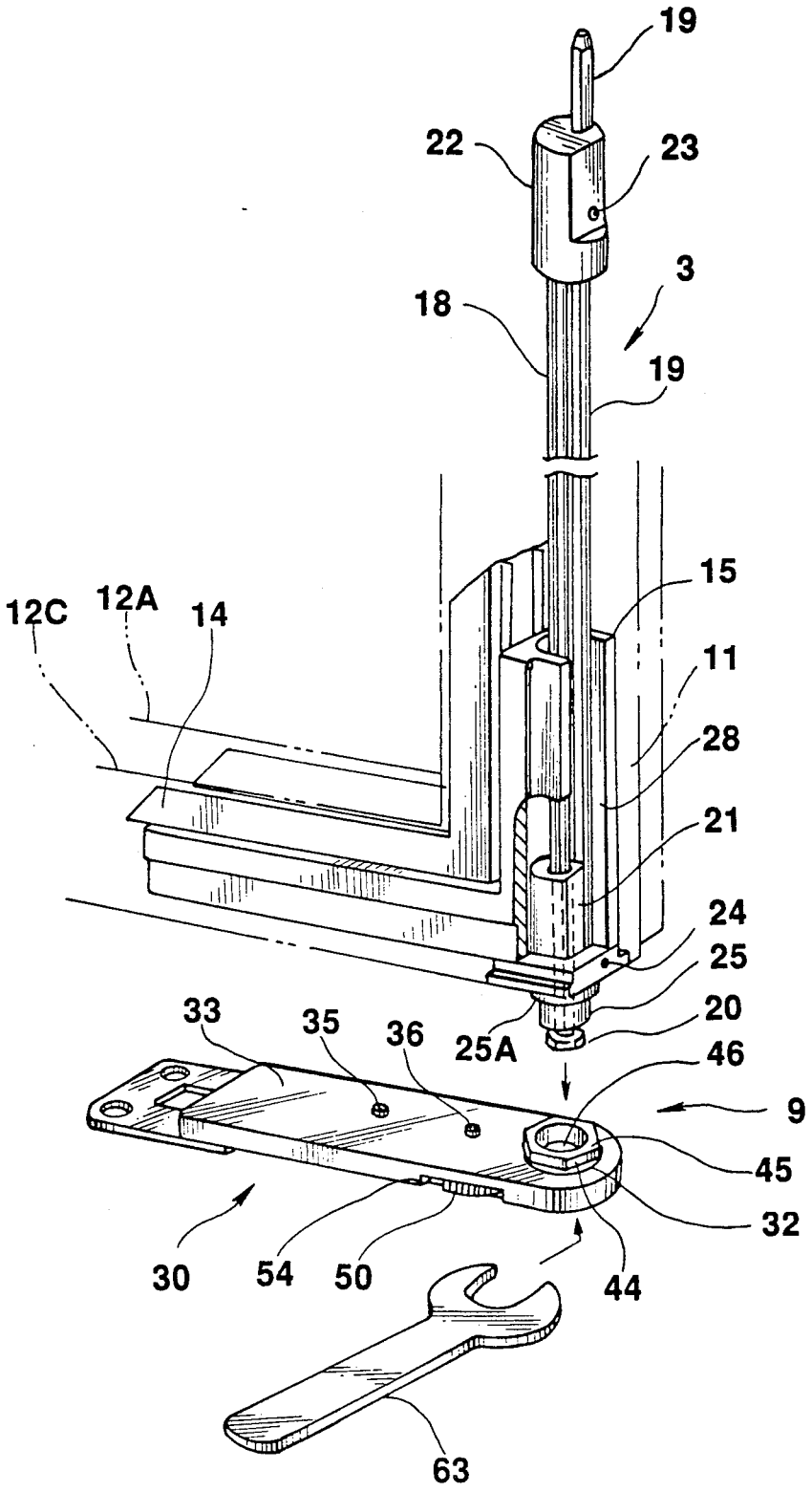
FIG. 3 is an opened-up perspective view of an embodiment of the torsion bar apparatus for a self-closing door apparatus according to the present invention.

As shown in FIG. 3, a torsion bar apparatus 3 is composed of two torsion bars, namely, a first torsion bar 18 and a second torsion bar 19, each of which consists of a spring steel having a length of 600 mm and a square section of 3.2 mm×3.2 mm, a hexagon nut 20 fixed to the lower end of the first torsion bar 18 so as to be unable to rotate, a fitting metal 21 through which the torsion bar 18 is rotatably passed, and a connecting member 22 for receiving the upper end of the torsion bar 18 and fixing the upper end by a screw 23 so as to be unable to rotate.

The upper end of the torsion bar 19 is pierced through the connecting member 22 so as to be unable to rotate and be movable vertically, and faces the cover 10. The torsion bar 19 extends downward from the connecting member 22, and the lower end thereof is fixed to the fitting metal 21 by a screw 24 so as to be unable to rotate. The lower end portion of the fitting metal 21 is protruded downward from the sash 11 and a cylindrical nylon hinge collar 25 having a collar portion 25A is placed thereover. The hexagon nut 20 is the engaged with the lower end of the fitting metal 21 below the hinge collar 25.

Figure 4:
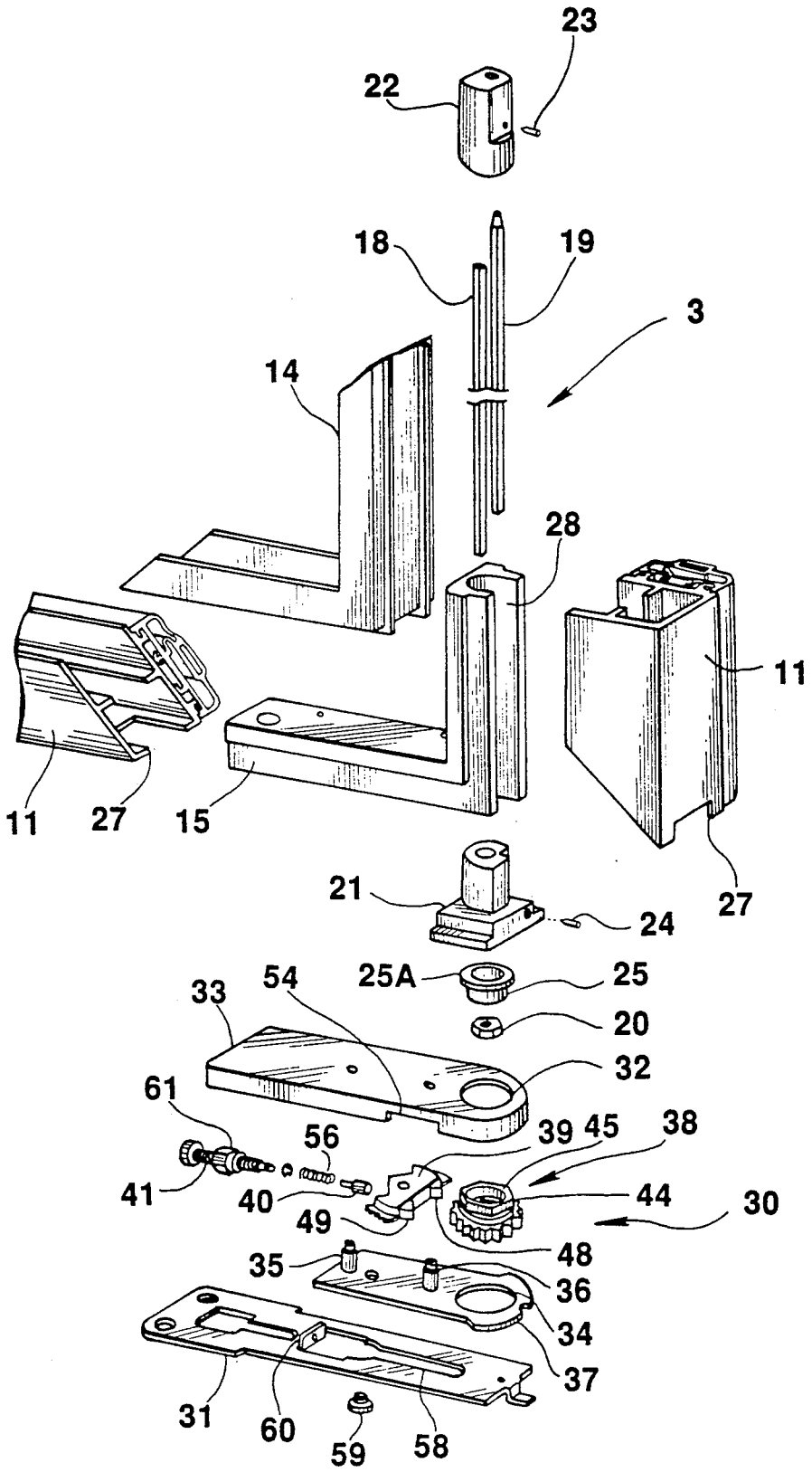
FIG. 4 is an exploded perspective view of the embodiment shown in FIG. 3.
Figure 5:
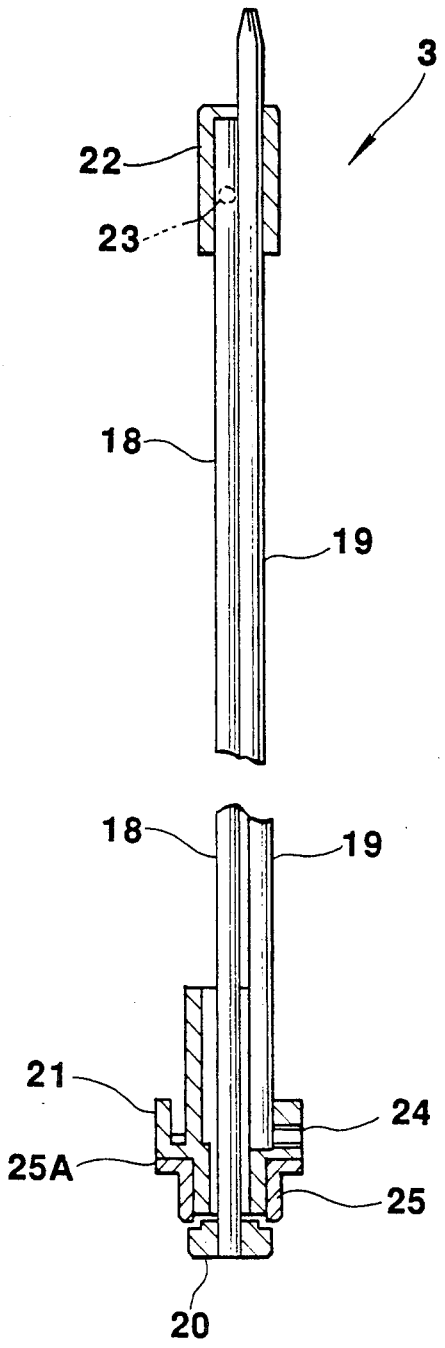
FIG. 5 is a vertical sectional view of the embodiment shown in FIG. 3.

Referring to FIG. 4, the torsion bar apparatus 3 is inserted into the sash 11 through a notch 27 formed at a lower corner portion of the sash 11 of the door 7, and passed through a groove 28 formed in the vertical piece of the corner reinforcing fitting metal 15. The connecting member 22 at the upper end portion of the torsion bar apparatus 3 is positioned at a distance of about 100 mm downward from the center of the door 7, as shown in FIG. 2. Since the connecting member 22 is apart from the cover 10, the torsion bar apparatus 3 does not come into contact with the wiring within the sash 10, thereby preventing interference with each other. The connecting member 22 is inserted into the sash 11 in such a manner as to be vertically movable and rotatable therewithin, and the fitting metal 21 is secured to the lower corner portion of the sash 11 in the removable engagement therewith in the vicinity of the notch 27.

A torque adjusting device 30 is attached to the frame 6 below the torsion bar apparatus 3. The torque adjusting device 30, the fitting metal 21 and the hinge collar 25 substantially constitute the lower hinge device 9.

The torque adjusting apparatus 30 is composed of a steel base plate 31 which is fixed to the frame 6, a lid 33 with a circular hole 32 formed at one end thereof, a sliding plate 37 provided with a circular hole 34 at one end thereof and two shafts 35, 36 erected in parallel with the circular hole 34, a rotating member 38 rotatably inserted into the holes 32 and 34, a stopper 30 rotatably supported by the shaft 36, a stopper presser 40 inserted between the stopper 39 and the shaft 35, and a sliding screw 41, as shown in FIG. 4. The upper ends of the shafts 35, 36 are fixed to the lid 33.

Figure 6:
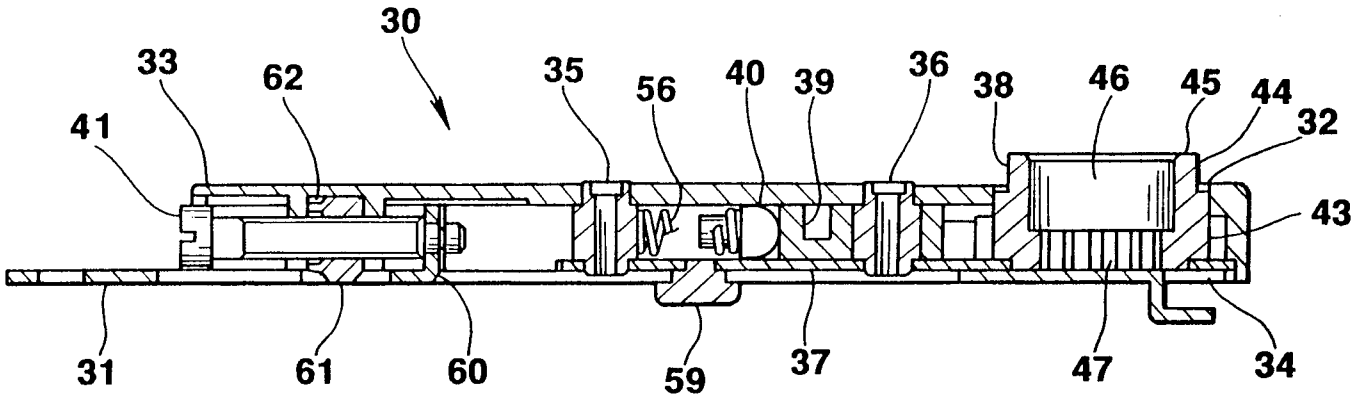
FIG. 6 is a vertical sectional view of an embodiment of a torque adjusting device according to the present invention.
Figure 7:
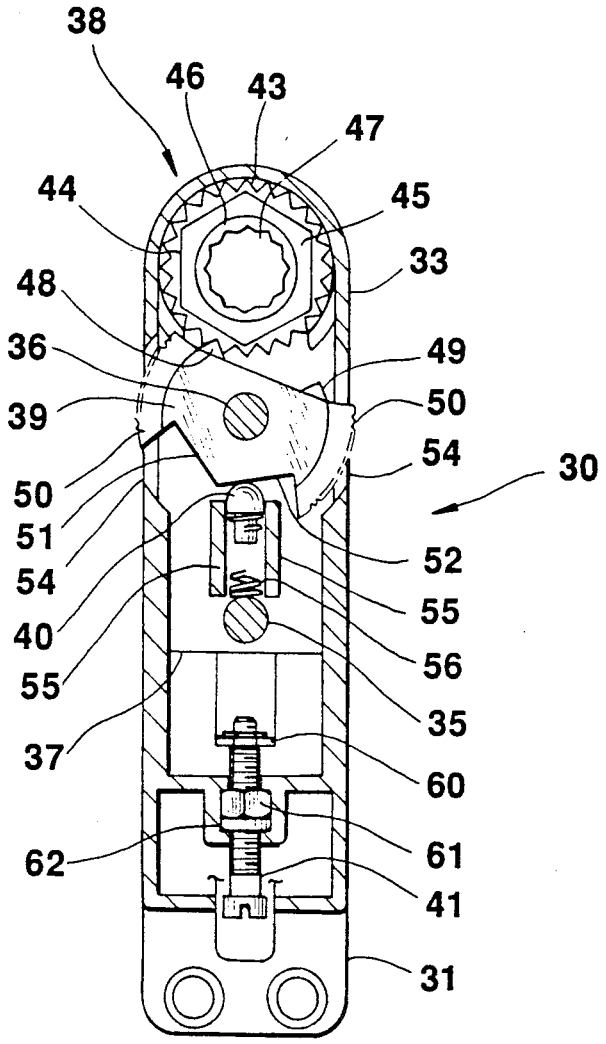
FIG. 7 is a plan view of the embodiment shown in FIG. 6, with the upper surface of a lid removed therefrom in order to explain the operation of the torque adjusting device.
Figure 9:
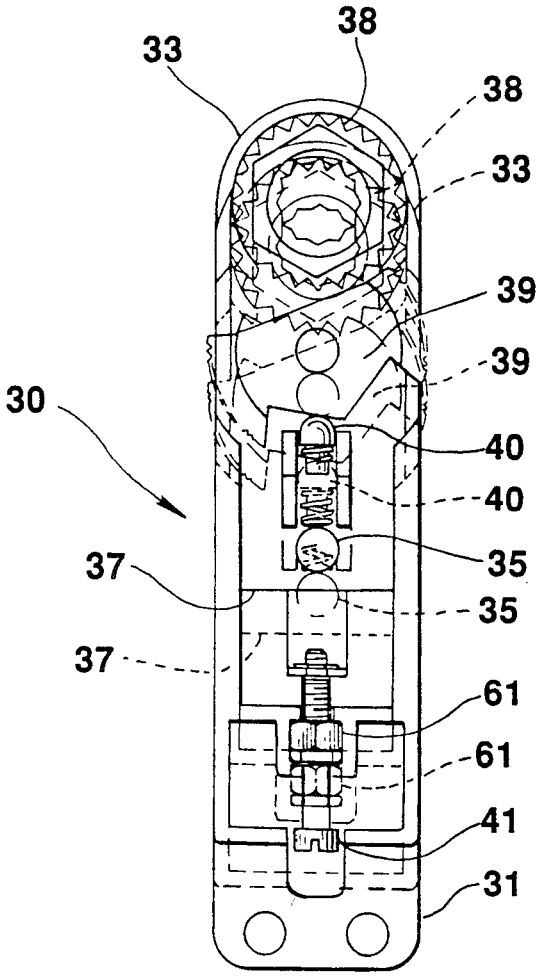
FIG. 9 is a plan view of the embodiment shown in FIG. 6, with the upper surface of a lid removed therefrom in order to explain the sliding operation of the torque adjusting device.

FIG. 6 is a sectional view of the torque adjusting device 30, and FIGS. 7 and 9 are plan views of the torque adjusting device 30 with the upper surface of the lid 33 removed therefrom. The rotating member 38 composed of a lower end portion which is rotatably inserted into the hole 34, a gear portion 43 on the lower end portion and a hexagon nut portion 44 on the gear portion is produced by integral molding. The hexagon nut portion 44 protrudes upward from the hole 32 of the lid 33 and is provided with a hole 46 opening upward and a seat 45 on the periphery of the hole 46. A holding portion 47 for holding the hexagon nut 20 so as to be unable to rotate is formed at the bottom portion of the hole 46.

Figure 8:
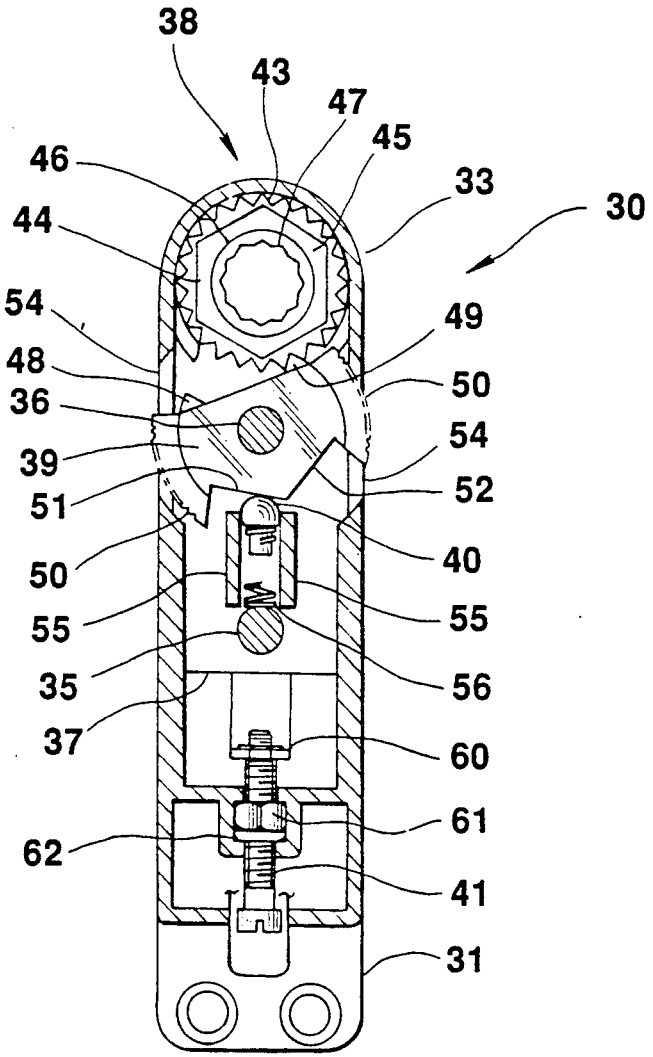
FIG. 8 is another plan view of the embodiment shown in FIG. 6, with the upper surface of a lid removed therefrom in order to explain the operation of the torque adjusting device.

As shown in FIG. 8, the stopper 39 has a pair of engaging portions 48, 49 protruded from both ends of a chord obtained by cutting a disk, protruding portions 50 which protrude from both sides of the chord in the opposite direction to the engaging portions 48, 49 in the shape of an arc, and a pair of inclined surfaces 51, 52 formed at the opposite positions of the engaging portions 48, 49 with the shaft 36 therebetween. The protruding portions 50 protrude outward from notches 54 which are formed on both side surfaces of the lid 33. The stopper presser 40 is clamped by a pair of blocking pieces 55 on the inside of the lid 33. The tip of the stopper presser 40 comes into contact with either of the inclined surfaces 51, 52 and is constantly biased toward the pair of inclined surfaces 51, 52 by a coil spring 56 which is inserted between the stopper presser 40 and the shaft 35.

The sliding plate 37 is slidably engaged with a longitudinal groove 58 formed on the base plate 31 by a rivet 59. The screw 41 is rotatably secured to an upright piece 60 which is erected on the base plate 31, and a nut 61 into which the middle portion of the screw 61 is screwed is accommodated in the storing portion 62 on the back surface of the lid 33 so as to be unable to rotate. The head portion of the screw 41 is exposed outside of the lid 33. According to this structure, when the screw 41 is tightened with a screwdriver, all the parts except the base plate 31 slide downward in FIG. 9 together with the lid 33, as indicated by the broken line. On the other hand, when the screw 41 is loosened, all the parts except the base plate 31 slide upward in FIG. 9. In this way, the vertical position of the lower hinge device 9 on the frame 6 is adjustable so as to cope with the inclination of the door 7. In FIG. 9, hatching is omitted in order to explain the operation clearly.

The handling and the operation of the torsion bar apparatus 3 and the torque adjusting device 30 will be explained. The direction of rotation of the stopper 39 is changed over in correspondence with the direction in which the door 7 is opened. For example, in the case of the left door 7 in FIG. 2, the rotational axis rotates counterclockwise. Therefore, if the rotating member 38 of the torque adjusting device 30 also rotates counterclockwise, the torsion bar apparatus 3 is not twisted. In this case, the stopper 39 is rotated clockwise, as viewed in FIG. 7, by the protruding portion 50 of the stopper 39 so as to engage the engaging portion 48 with the gear portion 43 of the rotating member 38. In this state, if the rotating member 38 is about to rotate counterclockwise in FIG. 7, the stopper 39 is about to rotate clockwise. However, this rotation is impossible because the engaging portion 48 and the protruding portion 50 are pressed against the rotating member 38. The counterclockwise rotation of the rotating member 38 is thus inhibited. On the other hand, the clockwise rotation of the rotating member 38 is possible because the engaging portion 48 engages the teeth of the gear portion 43 one by one against the pressing force of the coil spring 56 through the stopper presser 40.

When the direction in which the door 7 is opened is changed, the stopper 39 is rotated counterclockwise by the protruding portion 50 so as to engage the engaging portion 49 with the gear portion 43 of the rotating member 38, as shown in FIG. 8. As a result, the clockwise rotation of the rotating member 38 is inhibited in FIG. 8, while the counterclockwise rotation is allowed.

After the torque adjusting device 30 is set in this way and the torsion bar apparatus 3 is fixed to the door 7, the hinge collar 25 is inserted into the hole 46 of the rotating member 38, as shown in FIG. 3. At this time, the collar portion 25A of the hinge collar 25 is placed on the seat 45 and the hexagon nut 20 is inserted into the holding portion 47 so as to be unable to rotate. In this way, the lower end of the door 7 is rotatably supported by the lower hinge device 9. Thereafter, the upper end of the door 7 is rotatably supported by the upper hinge device 8, thereby completing the attachment of the door 7 to the frame 6.

Figure 10:
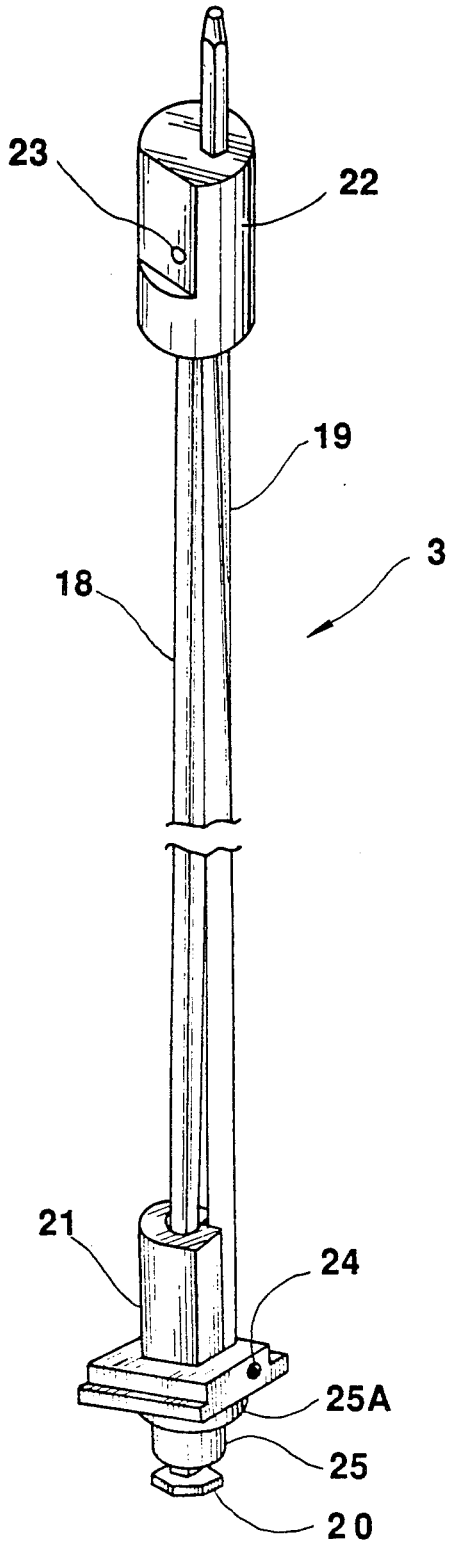
FIG. 10 is a perspective view of the embodiment of a torsion bar apparatus shown in FIG. 3, in a twisted state.

When the door 7 is opened, the fitting metal 21 of the torsion bar apparatus 3 also rotates counterclockwise, as viewed in FIG. 7. Since the hexagon nut 20 at the lower end of the torsion bar 18 is held by the holding portion 47 so as to be unable to rotate, the lower end of the torsion bar 19 also rotates counterclockwise around the torsion bar 18 with the rotation of the fitting metal 21. Consequently, the torsion bar 19 is twisted like a vine twining around the torsion bar 18, as shown in FIG. 10. At this time, since the torsion bar 19 is movable in the longitudinal direction with respect to the connecting member 22, the reduction in the dimension of the torsion bar 19 in the vertical direction is compensated. The torsion of the torsion bar 19 is transmitted to the torsion bar 18 through the connecting member 22, and the torsion bar 18 is also twisted. The self-aligning torque of the twisted torsion bar apparatus 3 applies a torque for closing the door 7 to the door 7. Thus, when the hold of the door 7 is released, the door 7 closes itself.

In order to produce the torque for closing the door 7 in the state in which the door 7 is closed, namely, the initial torque, a flat spanner 63 such as that shown in FIG. 3 is inserted between the door 7 and the torque adjusting device 30, and is engaged with the hexagon nut portion 44 so as to rotate the rotating member 38 and, hence, the hexagon nut 20 clockwise, as viewed in FIG. 7, thereby twisting the torsion bar apparatus 3 in advance. At this time, since the gear portion 43 of the rotating member 38 rotates while the teeth engage the engaging portion 48 one by one against the pressing force of the coil spring 56 through the stopper presser 40, it is possible to quantitatively detect the rotation angle of the rotating member 38 by counting the clatter or the shock produced at this time. The rotation angle can also be detected from the rotation angle of the spanner 63.

Figure 11:
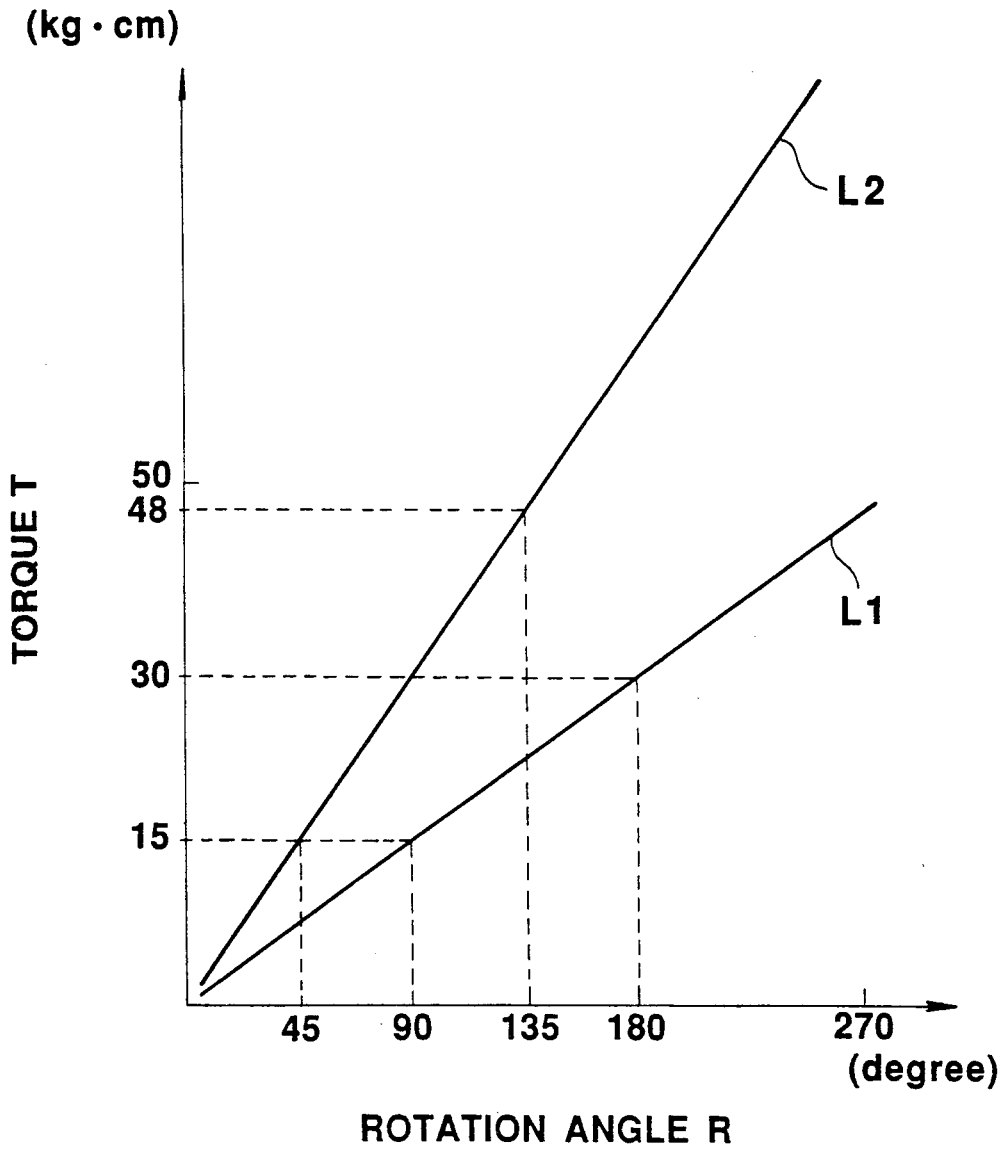
FIG. 11 shows the relationship between the rotation angle of a hexagon nut of a torsion bar apparatus and the torque generated by the torsion.

FIG. 11 shows the correlation between the rotation angle R (degree) of the hexagon nut 20 relative to the door 7 and the torque T (kg.cm) produced by the rotation of the hexagon nut 20. The line L1 shows the characteristic of the torsion bar apparatus 3 of the present invention and the line L2 shows the characteristic of a torsion bar apparatus produced by fixing the lower end of only one torsion bar, for example, the torsion bar 18 to the frame 6 and the upper end thereof to the door 7.

If it is assumed that the initial torque necessary when the door 7 is closed is 15 kg.cm, the rotation angle R applied of the hexagon nut so as to produce the initial torque is 90 degrees in L1 and 45 degrees in L2. If the door 7 is rotated by about 90 degrees, which is the limit to which the door 7 is opened, the torque T is 30 kg.cm at a rotation angle of 180 degrees in L1, while the torque T increases to 48 kg.cm at a rotation angle of 135 degrees in L2. This is because since the torque rapidly increases in proportion to the rotation angle when only one torsion bar is used, a large force is required for opening the door 7 in L2, in other words, the weight applied to the user during the door opening operation is large. In addition, since such a large stress is applied to the torsion bar, the torsion bar is easily broken due to metal fatigue.

In contrast, according to the torsion bar apparatus 3 of the present invention, in spite of substantially the same length of the torsion bars 18, 19 as that of the torsion bar in L2, the increase in the torque is gentle. In other words, when the initial torque is the same in L1 and L2, the force required for opening the door 7 is smaller in L1 than in L2. That is, the weight applied to the user during the door opening operation is small. In addition, since the torque T with respect to the rotation angle R is smaller, the stress applied to one torsion bar in the actual range in which the door is opened is smaller, so that the durability of the torsion bar is enhanced.

In order to return the initial torque to zero, the stopper 39 is rotated counterclockwise by the protruding portion 50, as viewed in FIG. 7, so as to release the engaging portion 48 from the gear portion 43. As a result, the rotating member 38 freely rotates by the retaining force of the torsion bar apparatus 3, so that the torsion of the torsion bar apparatus 3 is cancelled and the initial torque is restored to zero. In this way, it is possible to reduce the initial torque by rotating the rotating member 30 again after the initial torque is restored to zero. When the door 7 is removed in order to invert the direction in which the door 7 is opened, it is possible to prevent the hexagon nut 20 from forcibly rotating when it is released from the holding portion 47, thereby precluding a risk of breaking parts or injuring the worker.

Figure 12:
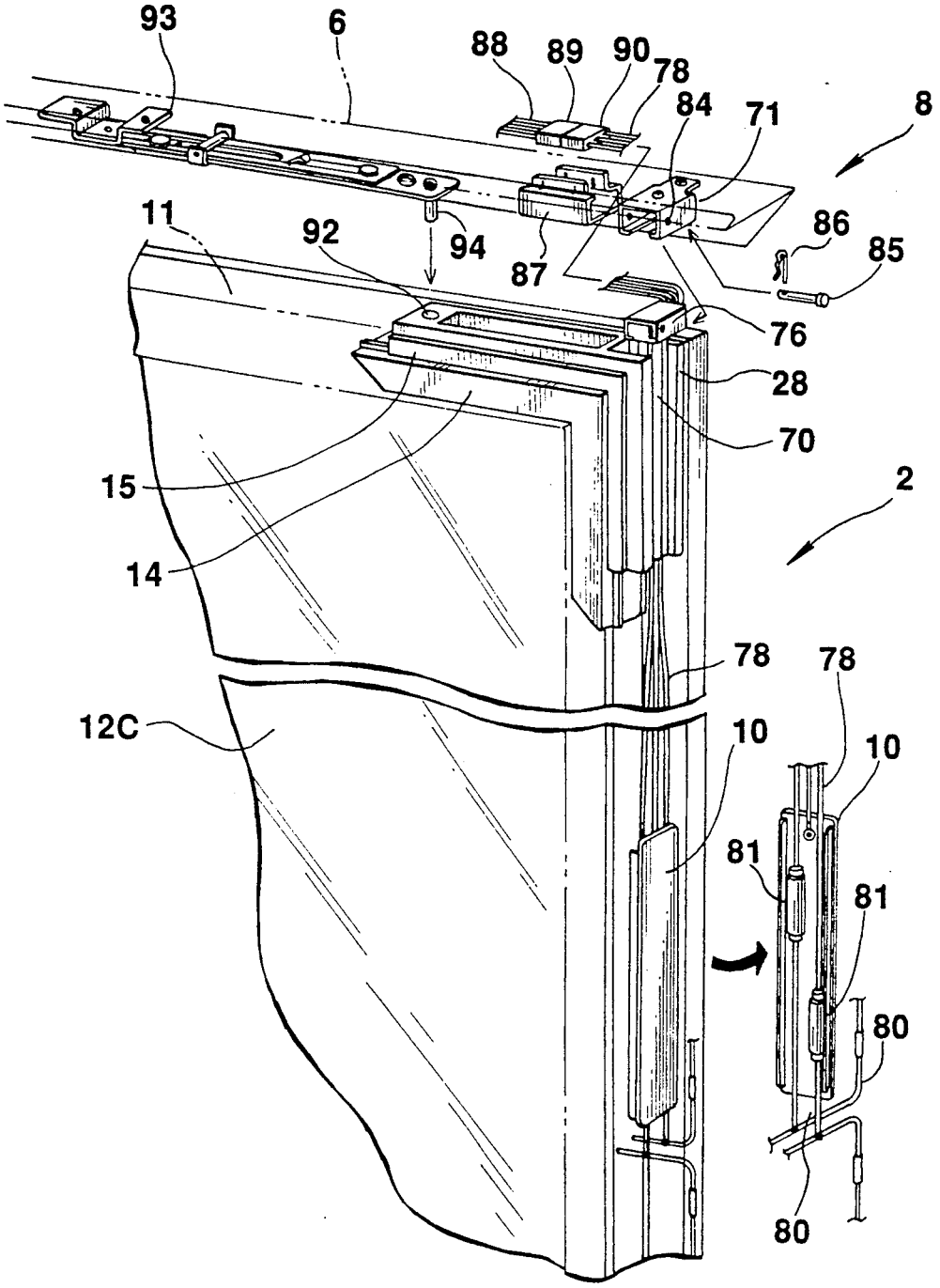
FIG. 12 is an opened-up perspective view of an upper hinge device of a self-closing door apparatus.
Figure 13:
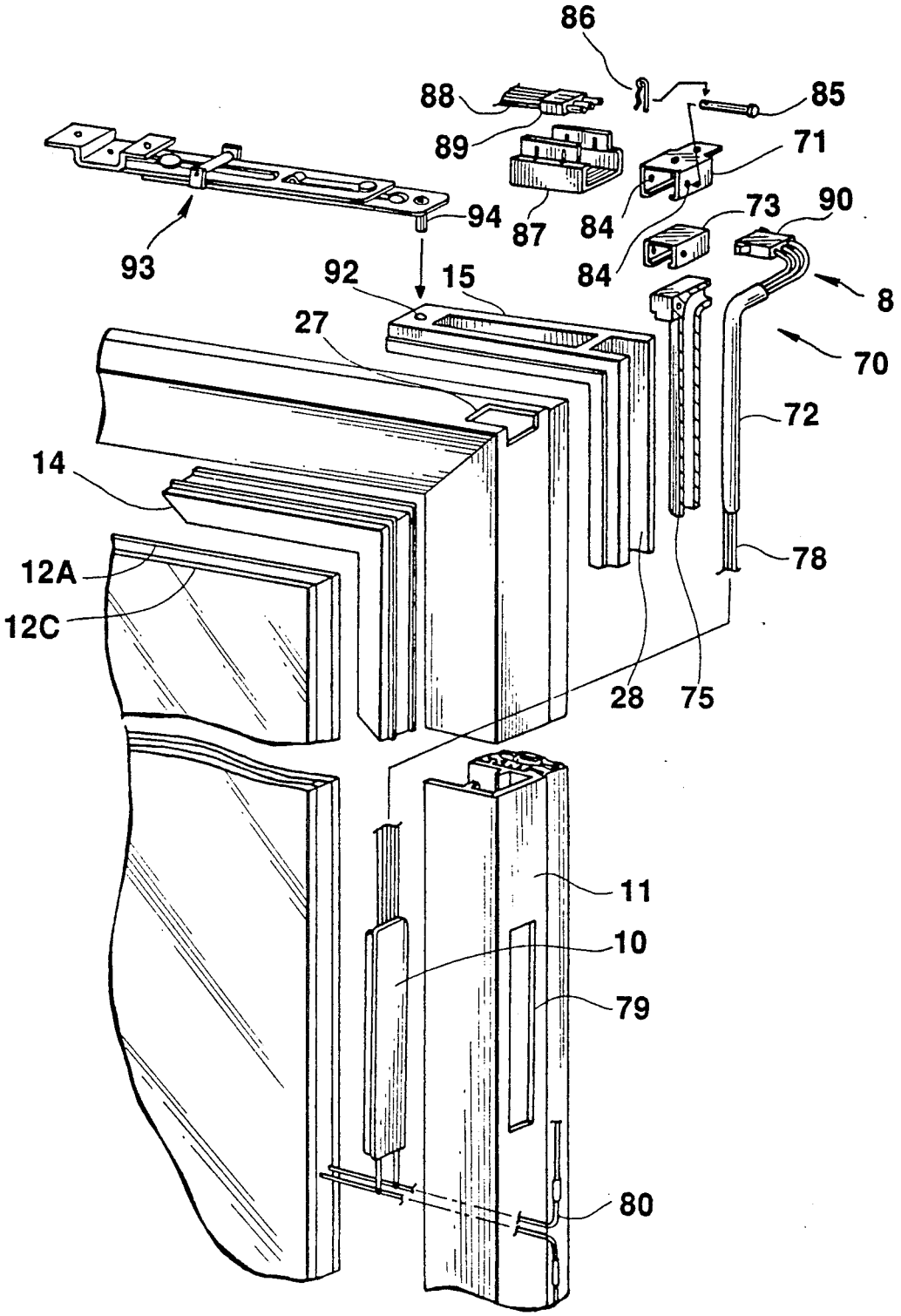
FIG. 13 is an exploded perspective view of the upper hinge device of a self-closing door apparatus shown in FIG. 12.
Figure 14:
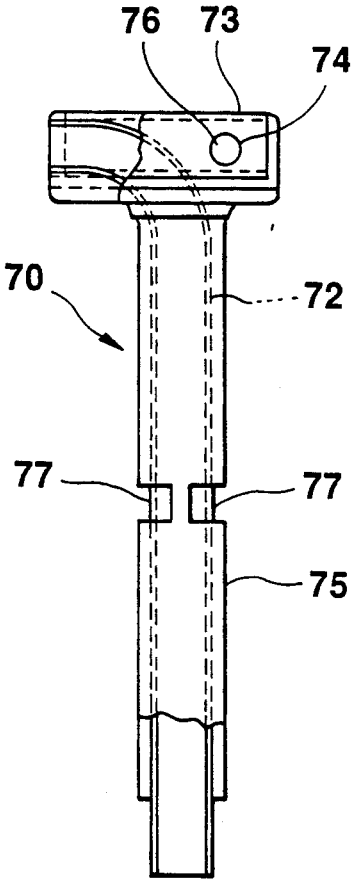
FIG. 14 is a side elevational view of the upper hinge device shown in FIG. 12.

FIG. 12 is an opened-up perspective view of the upper hinge device 8 of the self-closing door apparatus 2, and FIG. 13 is an exploded perspective view thereof. The upper hinge device 8 is composed of an upper hinge 70 and a receiving member 71. The upper hinge 70 is composed of a stainless steel pipe 72, a nylon coating layer 75 for covering the outer surface of the pipe 72, the nylon having a small surface frictional resistance, and a reinforcing plate 73 provided at the upper end of the coating layer 75, as shown in FIGS. 14 to 19.

Figure 15:
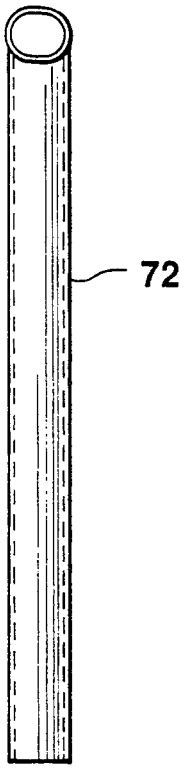
FIG. 15 is an elevational view of a pipe of the upper hinge device shown in FIG. 12.
Figure 16:
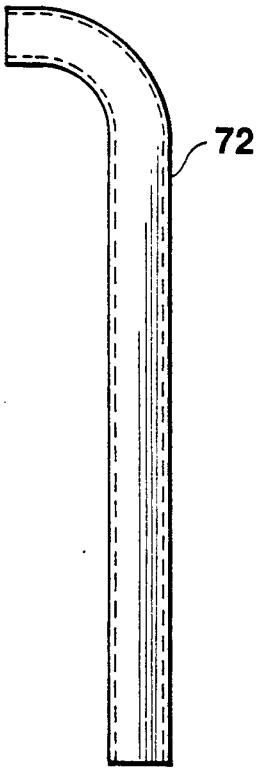
FIG. 16 is a side elevational view of the pipe shown in FIG. 15.
Figure 17:
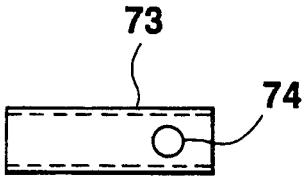
FIG. 17 is a side elevational view of a reinforcing plate of the upper hinge device shown in FIG. 12.
Figure 18:
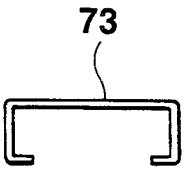
FIG. 18 is an elevational view of the reinforcing plate shown in FIG. 17.
Figure 19:
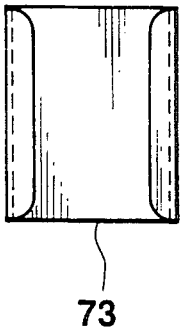
FIG. 19 is a bottom view of the reinforcing plate shown in FIG. 17.

The pipe 72 is produced by bending the upper portion of a straight pipe substantially at a right angle with a predetermined bend radius, as shown in FIGS. 15 and 16. The pipe has a flat section so as to increase the strength. The reinforcing plate 73 is a steel plate having a substantially arched section, as shown in FIGS. 17 to 19. A hole 76 is formed in both side surfaces of the reinforcing plate 73. The pipe 72, the coating layer 75 and the reinforcing plate 73 are integrally molded by placing the pipe 72 and the reinforcing plate 73 in a mold having a predetermined shape, pouring a nylon resin stock around the pipe 72 except for the upper and lower open ends of the pipe 72 and between the reinforcing plate 73 and the pipe 72, and solidifying the nylon resin stock. At this time, a through hole 76 is formed between the holes 74 of the reinforcing plate 73. Since the lower end and the center portion of the straight pipe portion are held during the molding process, the center portion of the straight pipe portion of the pipe 72 is exposed and a groove 77 is formed in the coating layer 75. If silicone grease is stored in the groove 77, the rotation of the door 7 is made smooth.

A plurality of lead wires 78 for constituting the wiring within the door 7 are movably inserted into the upper hinge 70. In this state, the upper straight pipe portion of the hinge 70 with the lead wires 78 led from the lower opening thereof is inserted into the sash 11 through a notch 27 of the sash 11 and rotatably and removably passed through the groove 28 formed at the upper corner portion of the corner reinforcing fitting metal 15. The lead wires 78 led from the opening at the lower end of the pipe 72 are extended to the center of the door 7. The lead wires 78 are connected with heating wires 80 within the door 7 by couplers 81 in a slot 79 formed at the center portion of the side surface of the sash 11. The couplers 81 are held by the inner wall of the synthetic resin cover 10, as shown in FIG. 12, and the cover 10 is removably engaged with the slot 79 in this state, thereby covering the slot 79. Since the couplers 81 are held by the cover 10, the insulating property is enhanced.

After the upper hinge 70 is attached to the door 7 and the lower end of the lower hinge 9 is rotatably supported by the frame 6, the opening at the upper end of the pipe 72 of the upper hinge 70 is faced to the back side of the door 7 and the reinforcing plate 73 is inserted into the receiving member 71 from the front side of the door 7. The receiving member 71 has an inner diameter which is substantially equal to the outer diameter of the reinforcing plate 73 and has a substantially arched section. A hole 84 is formed in both side surfaces of the receiving member 71. The holes 84 of the receiving member 71 and the through hole 76 are aligned and a pin stopper 85 is inserted into the holes. A catch 86 for preventing the pin stopper 85 from coming off is attached to the end of the pin stopper 85, whereby the upper hinge 70 is fixed to the frame 6 and the upper end of the door 7 is rotatably supported by the frame 6.

The end portions of the lead wires 78 led from the opening at the upper end of the pipe 72 of the upper hinge 70 are led from the receiving member 71 to the back side of the door and connected to lead wires 88 which are led from the heat insulating box body 4 by couplers 89 and 90 within a guarding member 87 which is disposed in parallel with the receiving member 71. The lead wires 78 are movably inserted into the pipe 72 and are not fixed to the upper hinge 70 at any portion. Therefore, when the portions of the lead wires 78 in the cover 10 are twisted by the rotation of the door 7, since the lead wires 78 from the coupler 90 to the coupler 81 can freely move in the pipe 72, the lead wires 78 are not broken.

A hole 92 is formed at the inner end of the horizontal piece of the corner reinforcing hitting metal 15. The shaft 94 of a rotation degree regulating member 93 for regulating the rotation degree of the door 7 is inserted into the hole 92 so as to prevent the door 7 from opening by more than about 90 degrees.

The torsion bar apparatus 3 is applied to the door having a pane in this embodiment, but the present invention is not limited thereto and it is applicable to an ordinary steel door. The present invention is not limited to a refrigerator and it is also applicable to a freezer, a heating cabinet, etc.

As described above, according to the torsion bar apparatus for a self-closing door of the present invention, it is possible to maintain the initial torque and to suppress the increase in the torque for opening the door to a low degree while reducing the entire length of the torsion bar apparatus itself. It is therefore possible to reduce the weight applied to the user during the door opening operation while maintaining the tightness with which the door is closed and to enhance the durability of the torsion bar itself.

Since the entire length of the torsion bar apparatus is reduced, it is possible to prevent the torsion bar apparatus from coming into contact with and, hence, interfering with other parts within the door. The length of the torsion bar apparatus is not restricted by the length of the door, and the torsion bar apparatus is also applicable to a small door while maintaining the characteristics of a long torsion bar. Thus, the torsion bar apparatus according to the present is vary advantageous for a self-closing door.

According to the torque adjusting device of the present invention, it is easy to cope with the change in the direction in which the door is opened by changing over the direction of rotation of the stopper, as described above. In the case of applying the initial torque to the torsion bar apparatus, the degree of torsion of the torsion bar apparatus, namely, the rotation angle of the rotating member is quantitatively detected by counting the clatter or the shock produced every time a tooth of the gear portion comes into contact with the engaging portion of the stopper. It is therefore easy to set the initial torque.

Especially, since the rotating member is rotated by the self-aligning torque of the torsion bar apparatus and is restored to the state in which the initial torque is zero by releasing the engaging portion from the gear portion, it is possible to change the initial torque in the state in which the initial torque is zero, and it is also possible to prevent parts from being damaged and the worker from being injured.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A torsion bar apparatus for a self-closing door which produces action force in the direction in which said door rotatably supported by a frame is closed, said torsion bar apparatus comprising:

a first elongated torsion bar with one end thereof fixed to said frame;

a connecting member which is fixed to the other end of said first torsion bar so as to be unable to rotate and which is vertically movable and rotatably inserted into said door;

a second elongated torsion bar one end of which is engaged with said connecting member so as to be unable to rotate and be movable in the vertical direction and which extends toward said one end of said first torsion bar until the other end thereof is fixed to said door; and said first and second torsion bars being spaced from one another and having different longitudinal axes, said other end of the second torsion bar being rotatable around the first torsion bar, whereby opening of the self-closing door causes the second torsion bar to be twisted around the first torsion bar causing the second torsion bar to move vertically with respect to said connecting member.

2. A torsion bar apparatus for a self-closing door which is used for a door with one vertical side thereof rotatably supported by a frame by means of hinges, so as to produce a torsional torque in the direction in which said door is closed, said torsion bar apparatus comprising:

a first elongated torsion bar with lower end thereof fixed to said frame;

a connecting member which is fixed to the upper end of said first torsion bar so as to be unable to rotate and which is vertically movable and rotatably inserted into said door;

a second elongated torsion bar the upper end of which is engaged with said connecting member so as to be unable to rotate and be movable in the vertical direction and which extends toward the lower end of said first torsion bar until the other end thereof is fixed to said door; and said first and second torsion bars being spaced from one another and having different longitudinal axes, said other end of the second torsion bar being rotatable around the first torsion bar, whereby opening of the self-closing door causes the second torsion bar to be twisted around the first torsion bar causing the second torsion bar to move vertically with respect to said connecting member.

3. A torque adjusting device for a torsion bar apparatus for a self-closing door with one vertical side thereof rotatably supported by a frame by means of hinges, said torque adjusting device being attached to said frame, and one end of said torsion bar being fixed to said door and the other end thereof being fixed to said torque adjusting device, said torque adjusting device comprising:

a rotating member which is rotatable so as to adjust the torsional torque of the torsion bar apparatus, which includes a gear portion and a holding portion which receives said other end portion of said torsion bar apparatus and with which said other end of the torsion bar is engaged so as to be unable to rotate;

a stopper means for selectively switching the directions in which said rotating member is rotatable with respect to said frame, said stopper means including engaging portions which are pressed to removably engage said gear portion; and wherein the stopper means further comprises protruding portions for adjustment of the torque, and a pair of inclined surfaces for engagement with a stopper presser.

4. A self-closing door apparatus comprising:

a frame;

a door which is rotatably supported by said frame;

a torque adjusting device attached to said frame and including a holding portion;

a torsion bar apparatus for producing a torsional torque in the direction in which said door is closed;

said torsion bar apparatus including:

a first elongated torsion bar with one end thereof held by said holding portion so as to be unable to rotate;

a connecting member which is fixed to the other end of said first torsion bar so as to be unable to rotate and which is vertically movable and rotatably inserted into said doors;

a second elongated torsion bar one end of which is engaged with said connecting member so as to be unable to rotate and be movable in the vertical direction and which extends toward said one end of said first torsion bar until the other end thereof is fixed to said doors; and said first and second torsion bars being spaced from one another and having different longitudinal axes, said other end of the second torsion bar being rotatable around the first torsion bar, whereby opening of the self-closing door causes the second torsion bar to be twisted around the first torsion bar causing the second torsion bar to move vertically with respect to said connecting member.

5. A self-closing door apparatus according to claim 4, wherein said torque adjusting apparatus includes:

a rotating member which is rotatable so as to adjust the torque of said torsion bar apparatus and which has said holding portion and a gear portion; and a stopper for selectively switching the directions in which said rotating member is rotatable with respect to said frame, said stopper having engaging portions which are pressed to removably engage said gear portion.

* * * * *